United States Patent [19]

Wood et al.

[11] Patent Number: 4,732,069

[45] Date of Patent: Mar. 22, 1988

[54] KNIFE AND KNIFE HOLDER ASSEMBLY

[75] Inventors: Kenneth O. Wood, Ellington; William A. Loos, Broad Brook, both of Conn.

[73] Assignee: Gerber Scientific Products, Inc., Manchester, Conn.

[21] Appl. No.: 47,660

[22] Filed: May 8, 1987

[51] Int. Cl.[4] ..... B26D 3/08

[52] U.S. Cl. ..... 83/881; 83/546; 83/700; 83/879

[58] Field of Search ..... 83/861, 875, 879, 881, 83/546, 699, 700, 563; 30/161, 335, 293

[56] References Cited

U.S. PATENT DOCUMENTS

| | | | |
|---|---|---|---|
| 4,467,525 | 8/1984 | Logan et al. | 33/18.2 |
| 4,516,461 | 5/1985 | Schaeffer | 83/881 |
| 4,608,891 | 9/1986 | Frisby et al. | 83/881 X |
| 4,674,503 | 6/1987 | Peyman et al. | 83/881 X |

FOREIGN PATENT DOCUMENTS

| | | | |
|---|---|---|---|
| 866792 | 9/1981 | U.S.S.R. | 83/881 |

*Primary Examiner*—E. R. Kazenske

*Assistant Examiner*—Hien H. Phan

*Attorney, Agent, or Firm*—McCormick, Paulding & Huber

[57] ABSTRACT

A knife and knife holder assembly for use with a sheet material cutting machine includes a replaceable knife with a lower most tip point and a guard and clamp member having a shoe surface engagable with the material being cut to limit the knife's penetration. An adjustment means and a connecting means associated with the guard and clamp member and with the holder allow for quick and easy adjustment of the vertical position of the member on the holder to vary the amount by which the knife protrudes beyond the shoe surface, thereby adjusting its penetration, and also allows quick and easy movement of the member between tightened and loosened conditions relative to the holder, the knife being removable from and replacable in the holder and the member being vertically adjustable in its loosened condition, and the guard and clamp member in the tightened condition of the connecting means being itself fixed to the holder and also holding the knife clamped in a fixed position to the holder.

7 Claims, 7 Drawing Figures

KNIFE AND KNIFE HOLDER ASSEMBLY

BACKGROUND OF THE INVENTION

This invention relates to machines for cutting sheet material, and deals more particularly with improvements in the construction of the knife and knife holder assembly of such a machine.

The knife and knife holder assembly of this invention may be used with various different types of sheet material cutting machines, but it has particularly utility as part of a machine, such as shown by U.S. Pat. No. 4,467,525, for cutting signs or other graphics from laminated sheet material. In an exemplary case, the laminated sheet material used for sign-making purposes consists of a carrier layer of paper or the like having one face coated with a silicone or other release agent. A layer of colored vinyl or the like is superimposed on this release face of the carrier sheet and held to it by a thin layer of pressure sensitive adhesive which stays with the vinyl when the carrier sheet and vinyl are separated, and which is subsequently used to attach the characters or other graphics cut from the vinyl to a supporting surface.

In the cutting of characters and other graphics from the vinyl of the laminated sheet material the cutting knife should penetrate entirely through the layer of vinyl and the layer of adhesive, so as to completely separate the graphics from the remainder of its vinyl, but the knife should only slightly, if at all, penetrate the carrier sheet, so that the carrier sheet remains intact during and after the cutting process.

It is therefore essential that the depth of penetration of the cutting knife be accurately controlled to a tolerance of plus or minus about one thousandth of an inch or less. The knife and its holder may be spring and/or gravity biased toward the sheet material being cut; and a shoe surface engagable with the top surface of the sheet material may be provided on the holder to limit the downward movement of the holder and knife, but this is not sufficient to insure, with a standard mounting of the knife to the holder, the proper degree of knife penetration. First of all, the thickness of the vinyl and adhesive layers, and possibly other layers, to be cut through by the knife before reaching the carrier layer may vary from one piece of laminated sheet material to another. Further, it is often desired that the knife be of a simple disposable type allowing it to be discarded when dull and replaced by a fresh knife. The manufacturing tolerances on such disposable knives may be such as to allow for a slight variance in knife length from one knife to another so that when a dull knife is replaced by a new one the new one may not have the same degree of penetration as the old.

The general object of this invention is therefore to provide a knife and knife holder avoiding the above mentioned problems, the construction more particularly being such that the knife can be readily removed from and replaced into the holder and the holder including a member providing a shoe surface which member is easily vertically adjustable to adjust the degree of penetration of the knife into the sheet material being cut.

Other objects and advantages of the invention will be apparent from the following detailed description of a preferred embodiment of the invention and from the accompanying drawings and claims.

SUMMARY OF THE INVENTION

The invention resides in a knife and knife holder assembly for use in a machine for cutting sheet material with the knife holder having a lower end portion providing a flat vertical surface with a vertically extending slot for receiving a replacable knife. The knife extends downwardly from the holder to a tip point defining the lowermost extremity of the knife. A guard and clamp member provides a downwardly facing shoe surface engagable with the top surface of the material being cut to limit the penetration of the knife into the material. This guard and clamp member is associated with the knife holder through an adjusting means and a connecting means. The adjusting means is operable to adjust the vertical position of the member relative to the holder to vary the amount by which the knife extends downwardly beyond the shoe surface, thereby varying the knife's penetration into the material being cut, and the connecting means is movable between loosened and tightened conditions. In the loosened condition the guard and clamp member is free for vertical adjustment by the adjusting means and the knife is also free for removal from and replacement into the holder as when removing a used blade and inserting a new one; and in the tightened condition of the connecting means the guard and clamp member is held tightly in fixed position relative to the holder and also exerts a clamping force on the knife fixing it in the holder slot against movement relative to the holder.

DETAILED DESCRIPTION OF THE PREFERRED EMBODIMENT

Figure 1:
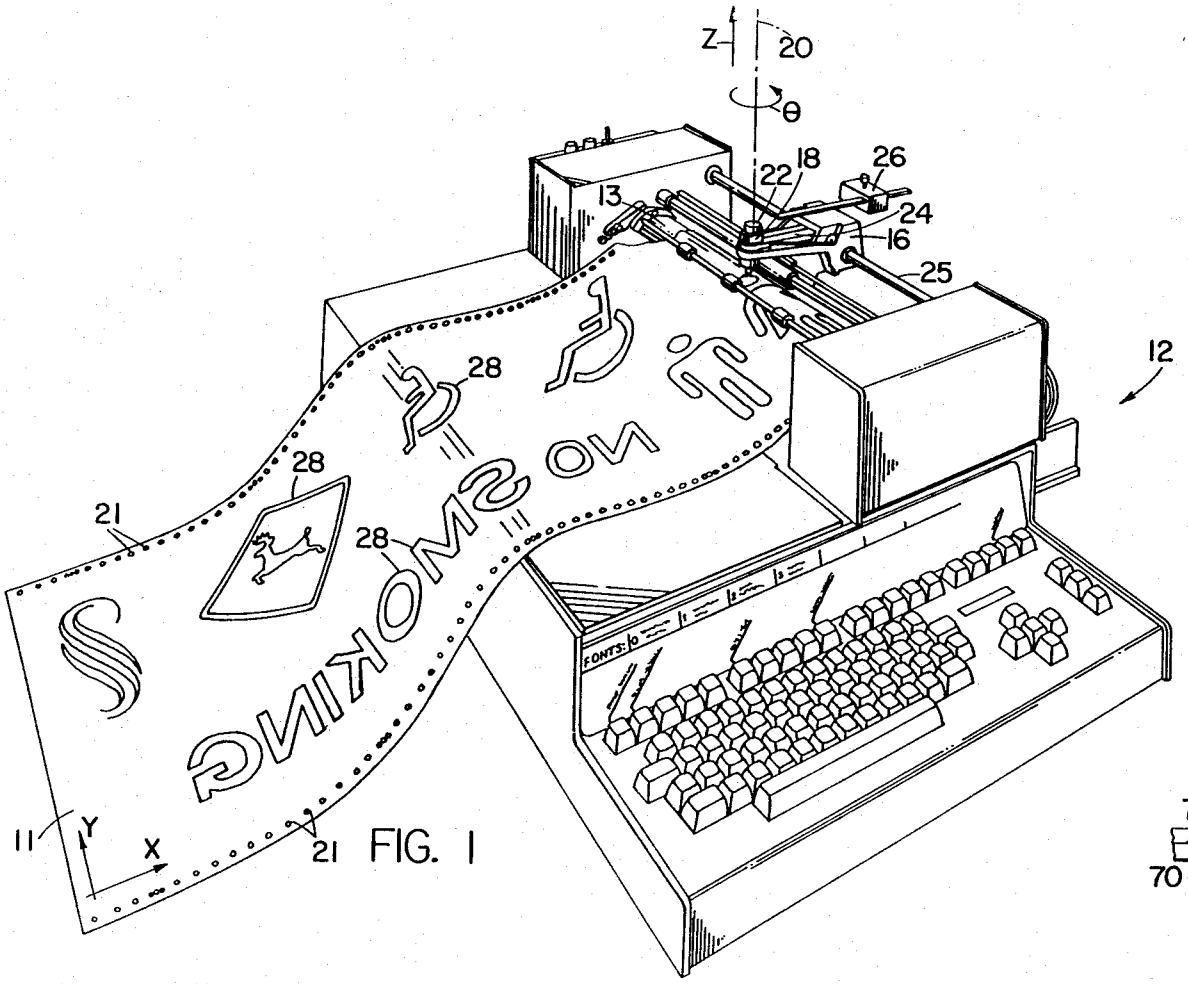
FIG. 1 is a perspective view of a sheet material cutting machine using a knife and knife holder assembly embodying the invention.

Referring to FIG. 1, the invention is there illustrated as embodied in a sign making machine 12 generally similar to the one shown and described in the aforementioned U.S. Pat. No. 4,467,523. The machine 12 handles and works on an associated web 11 of laminated sheet material. The web 11 is moved longitudinally of itself, in the illustrated X-coordinate direction, by a pair of drive sprockets (not shown) spaced from one another and having pins or teeth engageable with holes 21 in the two side edge portions of the web. The sprockets are located at the opposite ends of a platen or roller 13, similar to that of a typewriter, which supports a transverse portion of the web.

The machine also includes a tool head 16 suitably supported and driven in the illustrated Y-coordinate direction relative to the web 11. This tool holder carries a tool receiver 18 for rotation relative to the head about an axis 20 which is substantially vertical when the tool head is in the illustrated working relationship relative to the web 11. The tool receiver 18 has a hollow through-bore concentric with the axis 20 for receiving a tool and tool holder assembly selected from a number of such assemblies usually supplied with the machine. One such assembly may, for example, be a pen and pen holder assembly and another may be a knife and knife holder assembly. In FIG. 1 a knife and knife holder assembly 22 is shown to be inserted in the tool receiver 18. It is angularly fixed relative to the receiver by a key and slot arrangement and is axially fixed in the receiver by a set screw or other similar means. The receiver 18, and the tool assembly carried by it, is rotated about the axis 20 by a belt 24 powered by a motor (not shown). The tool head is gravity biased about the axis of a horizontal supporting rod 25 so that the tool assembly carried by the receiver 18 is urged toward the web 11; and a counterweight 26 is provided to allow adjustment of the downward force supplied to the tool.

Prior to the use of the machine 12 for cutting a web of laminated sheet material to make a sign, a web of paper may be substituted for the web 11 and a pen and pen holder assembly may be substituted for the knife and knife holder assembly 22. Then in the operation of the machine the pen draws on the paper. This procedure can be used to check the accuracy of the cutting program to be carried out by the machine under its automatic control before the actual cutting takes place.

In a normal cutting mode of operation, wherein the machine is used to cut a laminated web such as the one indicated at 11, a knife and knife holder assembly is carried by the tool receiver 18 and is moved in the X and Y-coordinate directions, in the $\theta$-coordinate direction about the axis 20, and in the Z-coordinate direction along the axis 20 (to move the knife into and out of cutting relationship with the web) to cut the desired characters or other graphics from the web 11. The web may vary in its exact construction, but usually it consists of a base layer or carrier sheet made of paper or the like having an upper face coated with silicone or other release agent. On top of this carrier sheet is a sheet of sign material, for example, of colored vinyl, from which the actual characters or graphics are derived. This sheet of sign material may be the uppermost sheet, but in some instances other additional protective sheets or the like may be included in the web. A thin layer of pressure-sensitive adhesive releasably holds the sheet of sign material to the carrier sheet and when the carrier sheet and sign material sheet are separated it remains with the sign material for use in attaching the cut characters or graphics to a supporting surface. Various characters cut from the upper or sign material layer of the web 11 of FIG. 1 are indicated at 28, 28.

Figure 2:
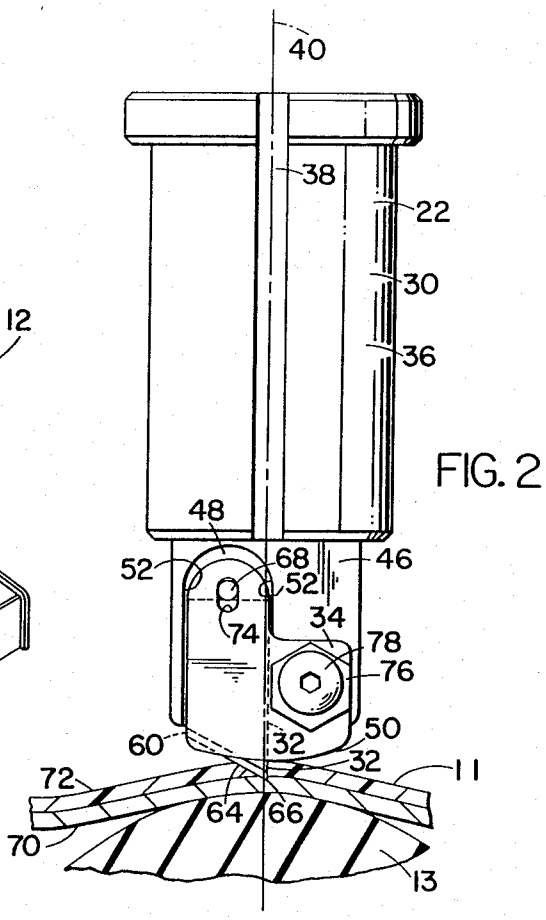
FIG. 2 is a side elevational view of the knife and knife holder assembly of FIG. 1 with the figure also including a fragmentary vertical sectional view of the material being cut and of the associated back-up roll.
Figure 4:
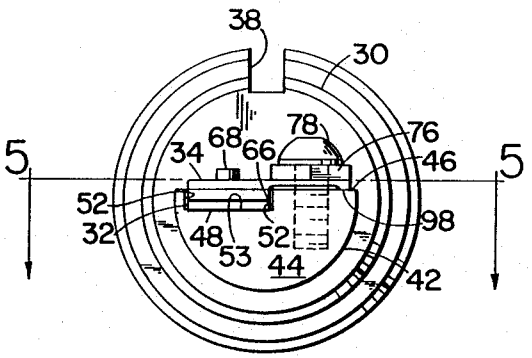
FIG. 4 is a bottom end view of the knife and knife holder assembly of FIG. 1.
Figure 3:
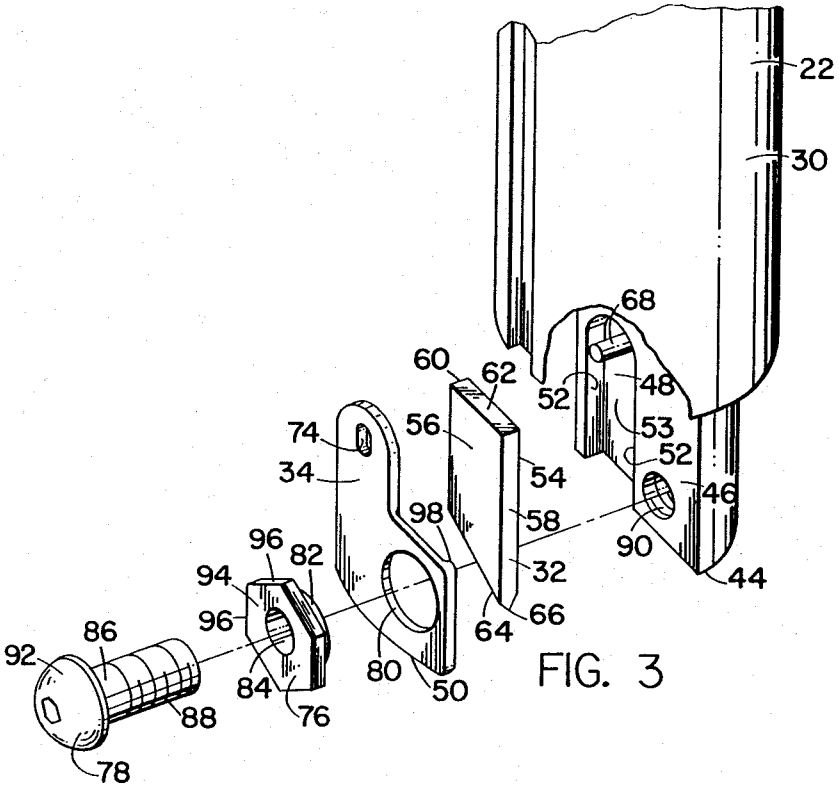
FIG. 3 is a fragmentary exploded perspective view of the knife and knife holder assembly of FIG. 1.

Turning to FIGS. 2, 3 and 4 the tool and tool holder assembly 22 of FIG. 1 is there shown in more detail, and in FIG. 2 is shown in the process of cutting the web 11 supported by the backup roll 13. The assembly 22 comprises basically a holder 30, a knife 32 and a guard and clamp member 34. The holder has an upper generally cylindrical portion 36 adapted to be slidably received by the receiver 18 and having a keyway 38 for cooperation with a key in the receiver to angularly fix the holder for rotation with the receiver, the holder having a central axis 40 which is colinear with the rotational axis 20 of the receiver when the holder is mounted in the receiver so that rotation of the receiver causes rotation of the holder about its central axis 40.

The holder 30 also includes a lower portion 42 having a downwardly facing end face 44 and a substantially flat vertical side face 46 with a vertically extending slot 48 for receiving the knife 32. The guard and clamp member 32 overlies part of the side face 46 and most of the knife 32 and has a generally downwardly facing shoe surface 50 which is engageable with the top surface of the web 11, as shown in FIG. 2, to limit the penetration of the knife.

The slot 48 is defined by two vertical side walls 52, 52 and a vertical bottom face 53, and the knife 32 has a complementary rectangular cross-section. More particulary the knife 32, as best seen in FIG. 3, has inner and outer flat vertical major faces 54 and 56, two vertical side edge faces 58 and 60, a horizontal top end edge face 62 and a sharpened bottom end edge 64. As seen in FIG. 3 the lower end edge of the knife is inclined so as to intersect the inboard side face 58 at a tip point 66 constituting the lowermost extremity of the knife. From the tip point 66 the edge 64 extends upwardly and laterally to intersection with the outboard side face 60.

From the above description of the knife 32 and the slot 48 it will be understood that the knife is restrained to vertical sliding movement in the slot 48. The upward limit of such movement is defined by engagement of the top end face 62 of the knife with a pin 68 fixed to the holder and extending horizontally outwardly from the bottom face 53 of the slot to and beyond the plane of the side face 46.

As seen in FIG. 2, the web 11, as previously explained, includes a bottom carrier sheet 70 of paper or the like and an upper layer 72 of vinyl or other sign material releasably held to the carrier sheet by a thin layer of intervening pressure-sensitive adhesive. The relationship of the knife 32 and the guard and clamp member 34 is preferably such, as illustrated, that the knife's tip point 66 is vertically spaced from the shoe surface 50 by an amount equal to or only slightly larger than the thickness of the layer 72 of the web 11 so that in the cutting operation the desired characters or other graphics are cut only from the layer 72 and not from the carrier sheet 70. Also, the arrangement is such that the tip point 66 is located on or very close to the central axis 40 so that rotation of the holder about the axis 40 does not change its position relative to the web 11.

The guard and clamp member 34 is associated with the holder 30 by both a vertical height adjustment means and a connecting means movable between loosened and tightened conditions. The adjustment means serves to adjust the height of the member relative to the holder to vary the amount by which the tip point 66 of the knife protrudes beyond the shoe surface 50 of the member, thereby allowing the protrusion to be set to suit the particular web material being cut and also allowing such protrusion to be set each time a new blade is mounted to the holder to adjust for possible differences in the length of the knife from one knife to another.

Figure 7:
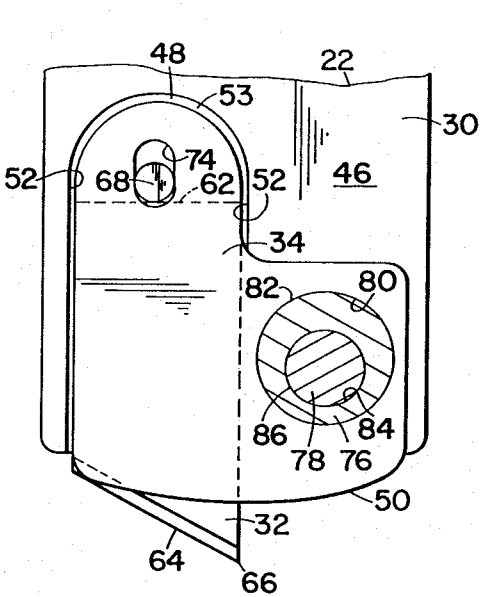
FIGS. 5, 6 and 7 are fragmentary side elevational views, partly in section taken on the line 5—5 of FIG. 4, showing the guard and clamp member in different positions of vertical adjustment.
Figure 6:
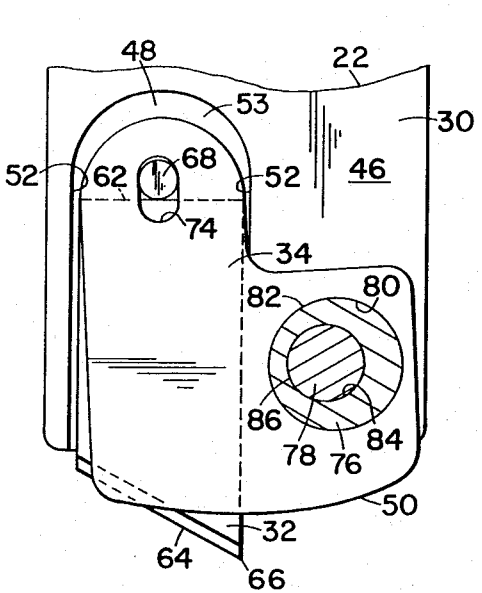
Figure 5:
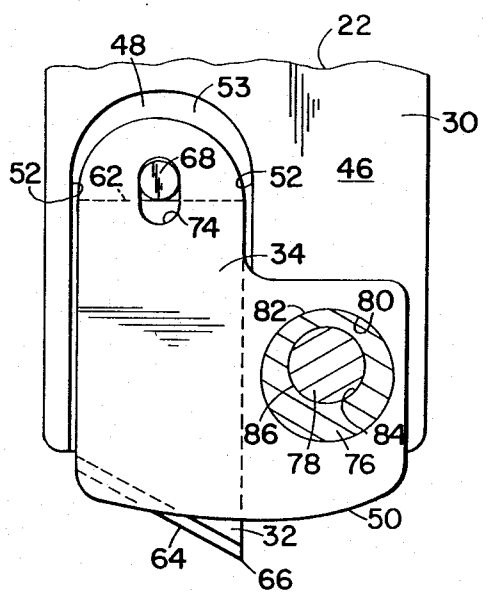

The adjusting means includes the pin 68 which extends through a vertically elongated slot 74 in the member 34. It also includes an eccentric nut 76 mounted on a screw 78 forming the connecting means. The member 34 has a circular horizontal opening defining a circular bearing surface 80. The nut 76 in turn has a cylindrical portion forming an external bearing surface 82 which fits complementary into and engages the surface 80 of the member. The nut 76 also includes a central opening having a cylindrical inner surface 84 which is received on a complementary outer cylindrical surface 86 on the screw 78. The inner cylindrical surface 84 is eccentrically related to the outer surface 82 of the nut, as best seen in FIGS. 5, 6 and 7. The screw 78 has a threaded inner end 88 which is threadably received by a threaded horizontal bore 90 in the holder.

The screw 78 has a head 92 and the nut 78 has a head 94 provided with flats 96, 96 which may be grasped by a wrench or other tool to rotate the nut on the screw.

When the screw 78 is threaded tightly into the hole 90 it, through the intervening head 94 of the nut clamps the member 34 to the holder to hold it in fixed position relative to the holder, and since the member 34 overlies the knife 32 it in turn clamps the knife between itself and the bottom 53 of the slot 48 to also hold the knife in fixed position relative to the holder. When, however, the screw 78 is loosened slightly the pressure of the member 34 on the knife is released allowing the knife to be slipped downwardly in the slot 48 to remove it from the holder and to allow the installation of a new knife. Also, the clamp member 34 is free for movement vertically relative to the holder, which can be accomplished by rotating the nut 76 to different positions, as shown for example in FIGS. 5, 6 and 7, to vary the amount by which the knife 32 protrudes beyond the shoe surface 50 of the member 34. After such adjustment is made the screw 78 may be returned to its tightened condition to hold the member 34 and knife 32 fixed in place on the holder. To aid in assuring a good clamping effect between the member 34 and the knife 32 the member 34 preferably, as seen in FIGS. 3 and 4, includes a generally vertically extending rib 98 on the side of the screw 78 opposite from the slot 48 to space the remainder of the inner face of the member 34 from the vertical face 46 of the holder.

We claim:

1. A knife and knife holder assembly for use in a machine for cutting sheet material, said assembly comprising:

a knife holder having a lower end with a downwardly facing lower end face and a flat vertical side face intersecting said end face and extending upwardly therefrom, said knife holder having a vertically extending slot in said side face, a knife positioned in said slot and having a lower portion extending downwardly beyond said end face of said holder, said lower portion of said knife having a generally downwardly facing cutting edge including a tip point constituting the lowermost extremity of said knife, a guard and clamp member laterally overlying said knife and said vertical side face of said holder and having a generally downwardly facing shoe surface located vertically between said tip point of said knife and said downwardly facing lower end face of said holder for engaging the top surface of sheet material to be cut, adjustment means for adjusting the vertical position of said guard and clamp member relative to said holder to adjust the vertical amount by which said tip point is vertically spaced from said shoe surface, and connecting means for connecting said guard and clamp member to said holder and which connecting means is movable between a loosened condition, at which said member is free for vertical adjustment relative to said holder by said adjustment means and said knife is free for vertical sliding movement relative to said holder for removal from and replacement into said holder, and a tightened condition, at which said member is fixed to said holder and said knife is also fixed to said holder by being clamped between said guard and clamp member and said holder.

2. A knife and knife holder assembly as defined in claim 1 further characterized by said adjustment means including cooperating parts on said holder and on said guard and clamp member defining a vertically elongated slot and a horizontal pin in said slot confining said guard and clamp member to substantially vertical and pivotal movement relative to said holder, said guard and clamp member having an opening of circular cross-section passing horizontally therethrough and defining a first internal bearing surface, a screw passing loosely through said opening in said member and having a horizontal central axis fixed relative to said holder, said screw having a cylindrical bearing portion located in said opening of said member and defining a first external bearing surface, and an eccentric nut received on said screw, said eccentric nut having a circular opening defining a second internal bearing surface complementary to and engaging said external bearing surface of said screw, said nut also having a circular outer surface arranged eccentrically to said second internal bearing surface, said circular outer surface constituting a second external bearing surface complementary to and engaging said first internal bearing surface of said member, and means on said nut which are graspable to rotate said nut relative to said holder about said horizontal axis of said screw, and said nut having a head located between said guard and clamp member and said head of said screw, said connecting means being said screw, said screw having a head positioned laterally outwardly of said eccentric nut and having a threaded inner end threaded into said holder, said screw being rotatable in one direction or the other about its central axis to move it between said loosened and tightened conditions.

3. A knife and knife holder assembly as defined in claim 2 further characterized by said graspable means on said nut being flats on said head of said nut.

4. A knife and knife holder assembly as defined in claim 2 further characterized by said slot in said side face of said holder being bounded by two vertical walls in planes perpendicular to said side face and said slot also having a flat bottom face parallel to said side face, said pin of said adjustment means being fixed to said holder and extending horizontally outwardly from said bottom face of said slot beyond said side face of said holder, said pin being spaced upwardly from said lower end face of said holder, and said elongated slot being formed in a portion of said guard and clamp member and receiving the portion of said pin which extends beyond said side face of said holder.

5. A knife and knife holder assembly as defined in claim 4 further characterized by said knife being of generally rectangular cross-section with inner and outer parallel major side faces, parallel vertically extending side faces, an upper end edge and a sharpened lower end edge, said upper end edge of said knife being engagable with said pin to limit the upward movement of said knife in said slot relative to said holder, and said lower end edge of said knife being inclined so as to intersect one of said side edge faces at said tip point and so as to extend upwardly and laterally away from said tip point to intersection with the other of said side edge faces, said inner major face of said knife being engagable with said bottom face of said slot, said outer major face of said knife being engagable with said guard and clamp member, and said side edge faces of said knife being engagable with said side walls of said slot.

6. A knife and knife holder assembly as defined in claim 5 further characterized by said holder having a vertical central axis about which said holder is rotatable, and said tip point of said knife being located substantially on said central axis.

7. A knife and knife holder assembly as defined in claim 6 further characterized by said guard and clamp member having a vertically extending rib located on its inner face on the opposite side of said screw from said slot which rib is engagable with said side face of said holder to space the remainder of said guard and clamp member slightly from said holder's side face to allow said screw in its said tightened condition to hold said guard and clamp member in tightly clamped relationship with said knife.

* * * * *